US009144298B2

(12) United States Patent
Fattori

(10) Patent No.: US 9,144,298 B2
(45) Date of Patent: Sep. 29, 2015

(54) ORAL CARE FLUID DELIVERY SYSTEM

(75) Inventor: Joseph E. Fattori, East Sandwich, MA (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 604 days.

(21) Appl. No.: 13/575,687

(22) PCT Filed: Jan. 28, 2011

(86) PCT No.: PCT/US2011/022988
§ 371 (c)(1),
(2), (4) Date: Jul. 27, 2012

(87) PCT Pub. No.: WO2011/094587
PCT Pub. Date: Aug. 4, 2011

(65) Prior Publication Data

US 2012/0301209 A1 Nov. 29, 2012

Related U.S. Application Data

(60) Provisional application No. 61/299,739, filed on Jan. 29, 2010.

(51) Int. Cl.
*A46B 11/00* (2006.01)

(52) U.S. Cl.
CPC ..... *A46B 11/0041* (2013.01); *A46B 11/0062* (2013.01); *A46B 11/0065* (2013.01); *A46B 11/0079* (2013.01); *A46B 2200/1066* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,743,042 | A | 4/1956 | Burgin | |
| 3,400,996 | A | 9/1968 | Vandergrift | |
| 3,864,047 | A | 2/1975 | Sherrod | |
| 3,903,888 | A | 9/1975 | Buelow et al. | |
| 4,893,957 | A | 1/1990 | Byriel | |
| 4,971,470 | A | 11/1990 | Moeck et al. | |
| 5,746,532 | A * | 5/1998 | Megill et al. | 401/175 |
| 5,769,585 | A | 6/1998 | Podolsky | |
| 5,918,995 | A | 7/1999 | Puurunen | |
| 6,179,503 | B1 | 1/2001 | Taghavi-Khanghah | |

(Continued)

FOREIGN PATENT DOCUMENTS

| | | |
|---|---|---|
| CN | 2888979 | 4/2007 |
| FR | 2357204 | 2/1978 |

(Continued)

OTHER PUBLICATIONS

International Search Report and Written Opinion of the International Searching Authority issued in International Application No. PCT/US2011/022988 mailed Jun. 8, 2011.

(Continued)

*Primary Examiner* — David Walczak

(57) ABSTRACT

An oral care implement having a fluid dispensing system for dispensing an oral care fluid. In one embodiment, the oral care implement may be a toothbrush including a handle, a neck and a head containing a plurality of tooth cleaning elements. Embodiments of the toothbrush further include a removable container or reservoir including a collapsible bladder that holds the oral care fluid. The bladder is in fluid communication with one or more fluid dispensing outlets disposed in the head. A manually actuated pump disposed in the handle provides the motive force for dispensing the fluid.

26 Claims, 11 Drawing Sheets

(56) References Cited

U.S. PATENT DOCUMENTS

| | | | | |
|---|---|---|---|---|
| 6,206,600 | B1 | 3/2001 | Rosenberg et al. | |
| 6,241,412 | B1 | 6/2001 | Spies et al. | |
| 6,257,791 | B1 | 7/2001 | Scamard | |
| 6,406,207 | B1 * | 6/2002 | Wiegner et al. | 401/272 |
| 6,691,712 | B2 | 2/2004 | Chu et al. | |
| 2004/0009029 | A1 | 1/2004 | Dillingham et al. | |
| 2007/0041779 | A1 | 2/2007 | Kuo | |
| 2007/0242280 | A1 | 10/2007 | Dickinson | |
| 2008/0205970 | A1 | 8/2008 | LaFlamme | |
| 2009/0119859 | A1 | 5/2009 | Podolsky | |
| 2010/0284726 | A1 * | 11/2010 | Ottaviani et al. | 401/187 |

FOREIGN PATENT DOCUMENTS

| | | |
|---|---|---|
| GB | 2 083 142 | 3/1982 |
| WO | WO2009/142643 | 11/2009 |
| WO | WO2010/128975 | 11/2010 |

OTHER PUBLICATIONS

Written Opinion of the International Preliminary Examining Authority issued in International Application No. PCT/US2011/022988 mailed Mar. 9, 2012.

Search Report from corresponding CN Application No. 201180007584.X issued Sep. 17, 2014. CN.

* cited by examiner

ORAL CARE FLUID DELIVERY SYSTEM

CROSS-REFERENCE TO RELATED APPLICATIONS

This application claims the benefit of U.S. Provisional Application No. 61/299,739, filed on Jan. 29, 2010. The disclosure(s) of the above application(s) is (are) incorporated herein by reference.

FIELD OF THE INVENTION

The present invention relates to oral care fluid delivery systems, and more particularly to an oral care implement such as a toothbrush equipped to dispense a flowable liquid oral care agent.

BACKGROUND OF THE INVENTION

Oral care implements such as toothbrushes are typically used in conjunction with a dentifrice for cleansing the teeth and/or soft tissue in the oral cavity. The dentifrice or similar oral care product may contain one or more ingredients which, when administered with a toothbrush generally via a brushing action, provide an oral health benefit to the user such as removing plaque and debris from the surface of the teeth and/or gums, polishing and whitening the teeth, reducing sensitivity, reducing oral surface bacteria populations, and others. However, it is often advantageous when brushing ones teeth to supplement the oral care benefits by further dispensing one or more additional oral care products in a liquid or fluid form to optimize the oral care regimen.

An improved oral care implement such as a toothbrush capable of dispensing oral care fluids while brushing is therefore desired.

BRIEF SUMMARY OF THE INVENTION

An oral care implement such as a toothbrush according to one embodiment of the present invention includes a fluid dispensing system capable of delivering an oral care fluid while brushing. The fluid may contain one or more active or inactive oral care agents.

According to one embodiment, a toothbrush with fluid dispensing system includes a handle, a neck supported by the handle, a head supported by the neck and preferably including a plurality of tooth cleaning elements, and a reservoir having a housing coupled to the handle and including a collapsible bladder holding an oral care fluid. The bladder is in fluid communication with a fluid dispensing outlet disposed in the head of the toothbrush. In a preferred embodiment, the housing is threadably coupled to the toothbrush handle. The toothbrush further includes a manually actuated pump disposed in the handle. A user actuating the pump causes the oral care fluid to flow from the bladder to the outlet wherein the fluid is dispensed from the toothbrush head. In some embodiments, the outlet may include a plurality of dispensing ports disposed in the toothbrush head. The fluid dispensing system preferably includes at least two check valves, which in preferred exemplary embodiment includes one valve each being disposed both upstream and downstream of the pump.

A method of dispensing an oral care fluid having oral care agents from a toothbrush is also provided. Exemplary embodiments of the method includes the steps of: providing a toothbrush including a handle, a neck supported by the handle, and a head supported by the neck portion, the toothbrush further including a fluid dispensing system; rotatably coupling a removable reservoir having a cavity including a collapsible bladder holding an oral care fluid to the handle; a user depressing an elastomeric convex surface of a manual pump fluidly connected to the fluid dispensing system; and dispensing the oral care fluid from an outlet in the head of the toothbrush.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
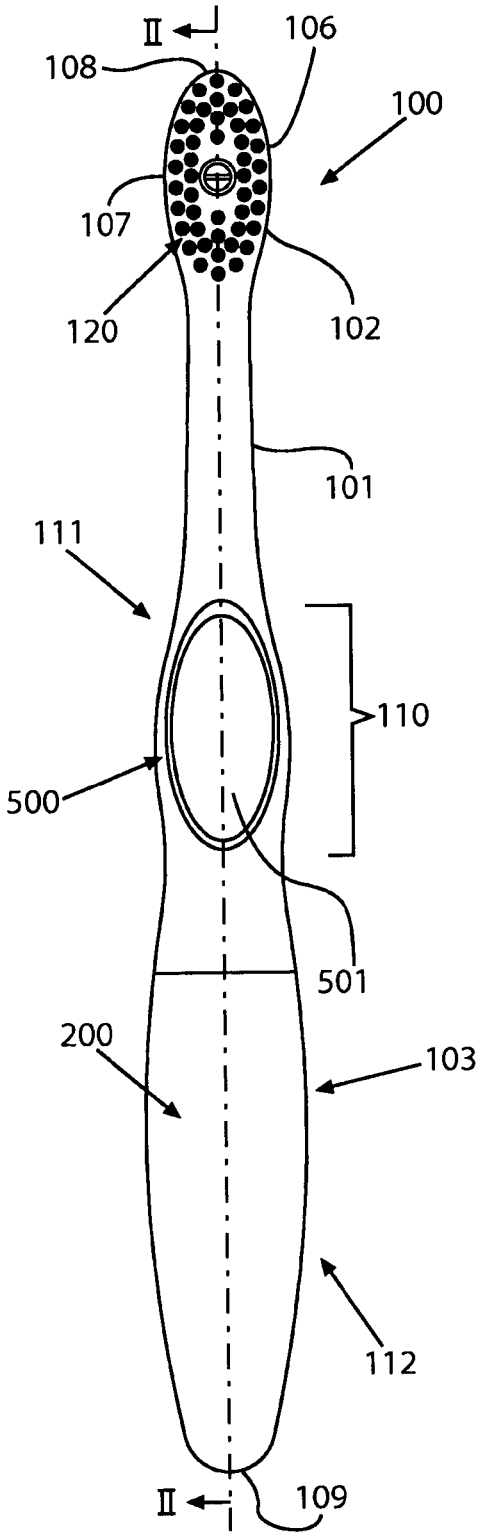
FIG. 1 is a top plan view of a toothbrush having a fluid dispensing system according to one exemplary embodiment of the present invention.

All drawings are schematic and not actual physical representations of the articles, components or systems described herein, and are further not drawn to scale. The drawings should be interpreted accordingly.

DETAILED DESCRIPTION OF THE INVENTION

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

In the description of embodiments of the invention disclosed herein, any reference to direction or orientation is merely intended for convenience of description and is not intended in any way to limit the scope of the present invention. Moreover, the features and benefits of the invention are illustrated by reference to preferred embodiments. Accordingly, the invention expressly should not be limited to such preferred embodiments illustrating some possible but non-limiting combination of features that may be provided alone or in other combinations of features; the scope of the invention being defined by the claims appended hereto.

FIG. 1 depicts one exemplary embodiment of an oral care system including an oral care implement in the form of a toothbrush 100 including a self-contained fluid dispensing system to be further described herein. Toothbrush 100 includes a head 102, a handle 103 configured for grasping by a user, and a neck 101 disposed therebetween coupling the head to the handle. Toothbrush 100 defines a longitudinal axis LA, a distal top end 108 at head 102, and a proximal bottom end 109 at handle 103. Handle 103 is generally elongated in shape and includes a forward distal portion 111 adjacent to neck 101 and a rear proximal portion 112 adjacent proximal end 109. Distal portion 111 further defines a thumb section 110 configured for a user to rest or press his/her thumb against whereas proximal portion 112 is generally configured for a user to grasp with his/her fingers while brushing. Handle 103 may have any suitable ergonomic and aesthetically pleasing configuration dimensioned to gripped by a user. Toothbrush 100 may be formed of one or more suitable materials conventionally used in the art for toothbrush handles including without limitation hard and/or resilient polymers, rubber, thermoplastic elastomers (TPE), and various combinations thereof. Accordingly, toothbrush 100 may be formed in many different functional and aesthetic configurations, lengths, and varieties of constructions.

Figure 2:
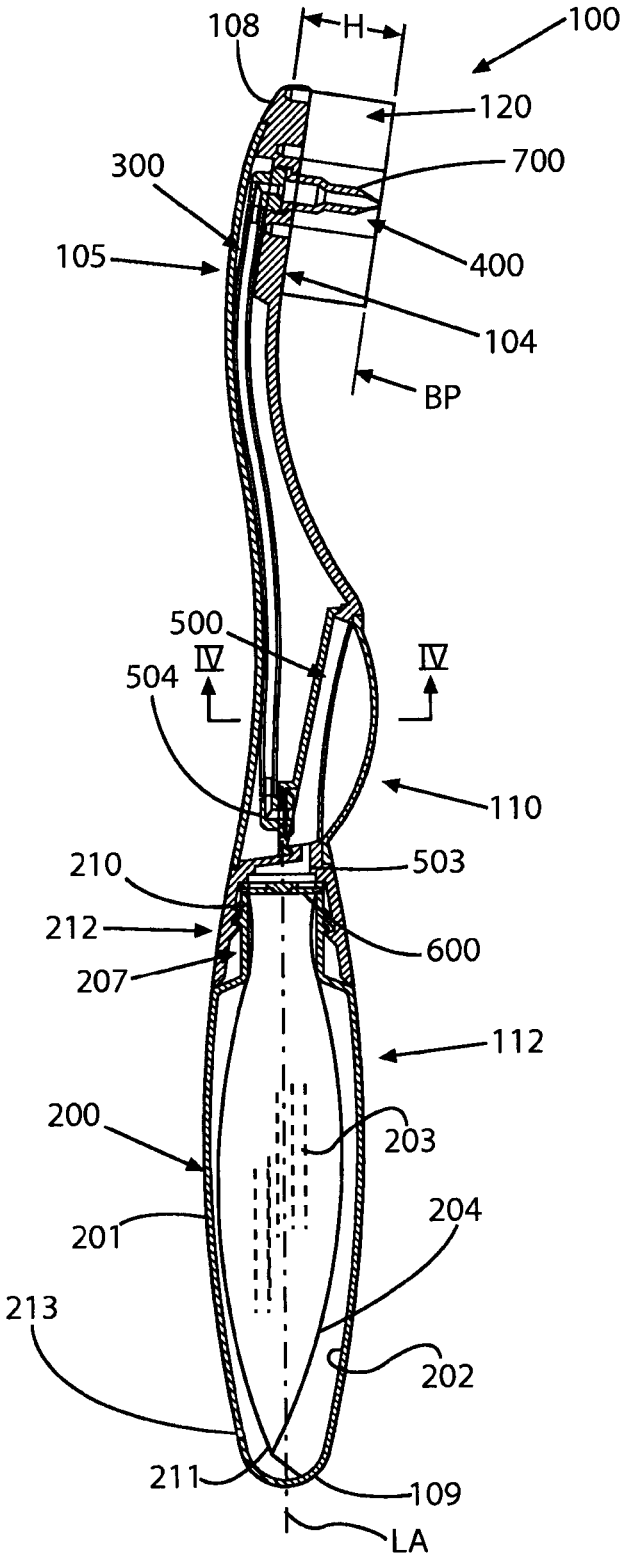
FIG. 2 is a longitudinal cross-sectional side view thereof taken along line II-II in FIG. 1.

FIG. 2 is a longitudinal side cross-sectional view of toothbrush 100 shown in FIG. 1. Referring to FIGS. 1 and 2, toothbrush head 102 further includes a front brushing side or surface 104, an opposing back side or surface 105, and two opposing lateral sides 106, 107. The shape of front and back surfaces 104 and 105 respectively may be generally planar/flat, curved, or any combination thereof. In some embodiments, back surface 105 may include an elastomeric tongue cleaner and/or other ancillary tooth or soft tissue cleaning elements (not shown). Toothbrush head 102 may have an elongated elliptical or oval shape in top view as shown in one possible embodiment; however, in other embodiments contemplated head 102 may be round in top view. Neck portion 101 may be tapered and generally narrower in lateral width than head 102 and thumb portion 110 in typical fashion to form a smooth transition therebetween.

With continuing reference to FIGS. 1 and 2, front side 104 of toothbrush 100 may support a plurality and variety of tooth cleaning elements 120 which are attached to toothbrush head 102 by any suitable conventional attachment method used in the art, including without limitation anchor free tufting (AFT) in mold tufting (IFT) and stapled/anchored. Tooth cleaning elements 120 may include a variety of bristle and/or flexible elastomeric cleaning and polishing elements. It should be noted that the bristle tufts or elements in the drawings may be illustrated in block form in some figures without the individual bristle strands being detailed for convenience and clarity so as to not obscure other structures on head 102. As shown in FIG. 2, tooth cleaning elements 120 collectively define an overall maximum height H measured upwards and transverse to front brushing surface 104 of toothbrush head 102 and defines an imaginary nominal reference brushing plane BP. Brushing plane BP is roughly defined by the upper free ends of the tooth cleaning elements 120 (with lower fixed ends being attached in brushing surface 104) and is offset from front brushing surface 104 of toothbrush head 102 (with some variation allowing for varying heights of some of the cleaning elements 120). The tooth cleaning elements 120 may be arranged in any suitable pattern and the invention is not limited by any particular arrangement, type, and/or number of tooth cleaning elements.

According to one aspect of the invention, the oral care system provided by toothbrush 100 includes an integrated fluid dispensing system adapted to store and dispense a liquid active oral care agent will now be described. Toothbrush 100 provides a compact, readily portable, and self-contained user-friendly oral care system that comprises components and chemistries necessary for a user to perform a desired oral care treatment routine including dentifrice and a supplemental fluid-based treatment. As will be described in greater detail below, the oral care system 100 in one exemplary embodiment generally takes the form of a modified toothbrush having a refillable and/or interchangeable removable container or reservoir 200 in preferred embodiments that is associated with toothbrush handle 103. Because the reservoir 200 is disposed or formed in handle 103 of the toothbrush 100, the oral care system advantageously is highly portable for travel, easy to use, and reduces the amount of required storage space in contrast to having separate toothbrush and oral care fluid containers or packages. Furthermore, since the toothbrush and dispenser are conveniently combined in a single housing together, this convenience will more likely compel the user to maintain an oral treatment routine with the oral care agent when brushing one's teeth.

Figure 3:
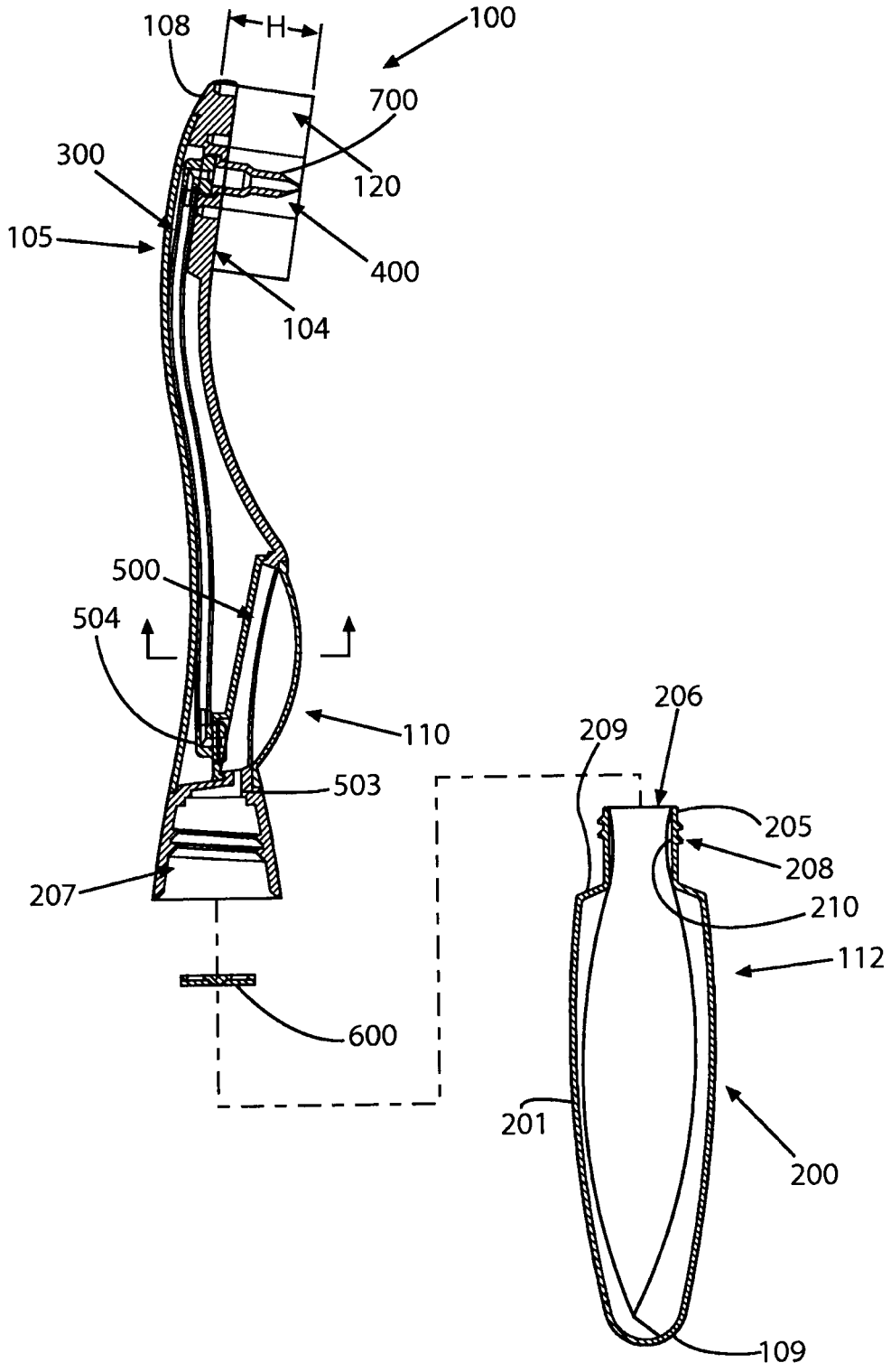
FIG. 3 is an exploded longitudinal cross-sectional side view thereof.
Figure 7:
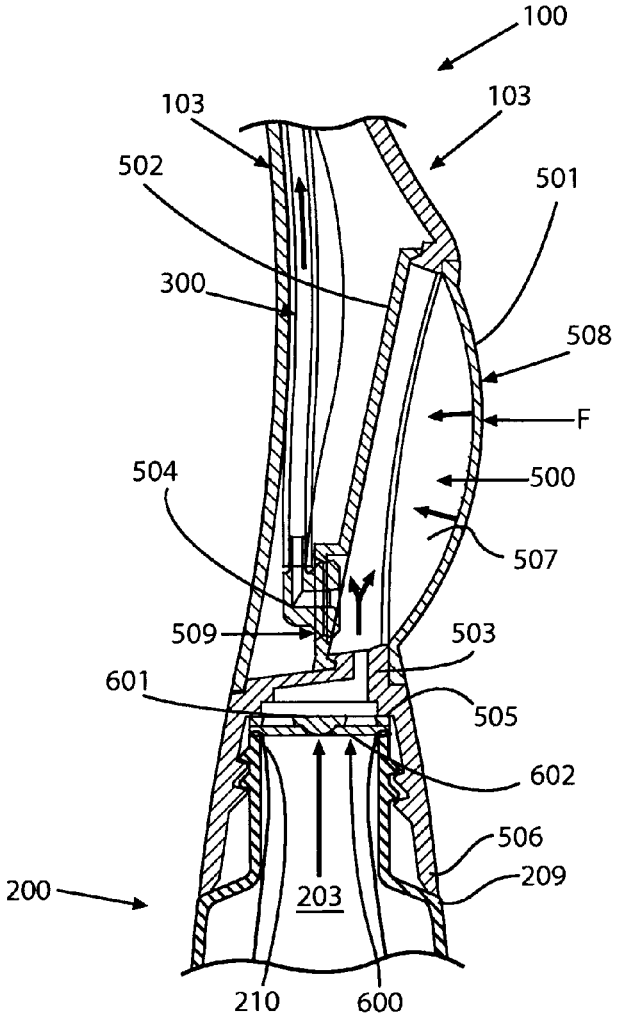
FIG. 7 is partial longitudinal cross-sectional side view thereof.

Referring to FIGS. 1-3 now, the fluid dispensing system will now be described in greater detail. The fluid dispensing system generally includes a removable container or reservoir 200 for storing an oral care agent, fluid dispensing outlet 400, and a flow conduit 300 fluidly connecting the reservoir to the outlet. Fluid dispensing system further preferably includes a first valve 600 and a second valve 700 to be more fully described herein. Reservoir 200 is preferably disposed in handle 103. In a preferred exemplary embodiment, reservoir 200 includes a generally hollow housing 201 that forms a removable part of rear proximal portion 112 of handle 103 as shown. Housing 201 is generally elongated and cylindrically shaped with a configuration that preferably smoothly blends into the overall contours and shape of handle 103 of toothbrush 100 as shown. Accordingly, in one preferred embodiment, housing 201 includes a forward facing peripheral annular edge 209 that is shaped and dimensioned to smoothly transition into a complementary shaped and dimensioned rearward facing peripheral annual edge 506 thereby forming a smooth joint between toothbrush handle 103 and reservoir 200, as best shown in FIG. 7. In other possible embodiments, a stepped joint may be formed between handle 103 and reservoir 200 (not shown).

Housing 201 may have a closed proximal end 109 (defining the same distal end of toothbrush 100) as shown in FIGS. 1-3, which in one embodiment may be tapered for user comfort in the palm of the hand when brushing. In other embodiments, proximal end 109 may include angled surfaces and/or be a flat surface disposed generally perpendicular to longitudinal axis LA of toothbrush 100. Preferably, however, proximal end 109 is closed. Housing 201 further includes an opposite open distal coupling end 205 which defines an end sealing surface 206 that fluidly connects to inlet connector 503 of pump 500, as further described herein. Open coupling end 205 provides a mouth or outlet for dispensing oral care fluid 203 contained in reservoir 200.

Reservoir 200 may be removably attached to distal handle portion 111 via any suitable conventional non-permanent mechanical coupling means including without limitation a threaded connection, releasable frictional or snap fit, or other. In a preferred exemplary embodiment, a threaded connection may be used as shown in FIGS. 2 and 3 wherein reservoir 200 is rotatably attached to handle 103. Accordingly, distal coupling end 205 of reservoir 200 may include a neck portion 212 of reduced in diameter compared to more rearward portions of the reservoir and includes a male threaded neck finish 208 having male threads which are rotatably coupled with a complementary rear facing female threaded socket 207 disposed on distal portion 111 of toothbrush handle 103. Any suitable threading configuration and pitch may be used so long as reservoir may be removably attached to handle 103. In other possible embodiments contemplated, distal coupling end 205 may alternatively be configured as a female threaded socket which rotatably couples with a male threaded neck finish on distal portion 111 of toothbrush handle 103 (not shown nor necessary to illustrate which will be readily evident to those skilled in the art). Accordingly, the invention is not limited to either of the foregoing threaded constructions or other arrangements.

Housing 201 defines a longitudinally-extending internal cavity 202 as shown in FIG. 2 which is configured and adapted for storing oral care agents that preferably are in the form of a flowable oral care fluid 203 having any suitable viscosity that permits the agents to flow through the fluid dispensing system when actuated by a user, as further described herein. Cavity 202 is preferably axially aligned with longitudinal axis LA of toothbrush handle 103.

Housing 201 of reservoir 200 is preferably made of a relatively hard or rigid non-deformable material so that oral care fluid 203 will not be dispensed inadvertently by the user during brushing until desired. In some exemplary embodiments, housing 201 may preferably be made of a moldable hard plastic, and more preferably a moldable thermoplastic. Suitable plastics may include without limitation polymers and copolymers of ethylene, propylene, polyethylene, polycarbonate, butadiene, vinyl compounds and polyesters such as polyethylene terephthalate. It will be appreciated by those skilled in the art that housing 201 need not be completely rigid so long as the likelihood of inadvertent fluid dispensing is minimized while the user is brushing.

With reference to FIGS. 1-3, reservoir 200 includes a deformable and collapsible pouch or bladder 204 in preferred embodiments that is disposed in cavity 202 of reservoir housing 201 and is fluidly coupled to flow conduit 300 and dispensing outlet 400, as further described herein. Bladder 204 containing oral care fluid 203 is movable between an expanded condition containing a first volume of fluid 203 and after dispensing a second collapsed condition containing a second volume of fluid less than the first volume. The benefits to using a collapsible bladder 204 as opposed to a piston cartridge, or non-collapsible container, include that a bladder requires less pressure from the actuator pump because there is no friction to overcome between a piston and housing. Additional benefits include reduced failure and leaking of the material in the bladder.

With continued reference to FIGS. 1-3 and additional reference to FIG. 7, bladder 204 includes a sealed or closed proximal end 211 and an open distal end 210. The forward most edges of distal end 210 are preferably annularly sealed to the interior surface of distal coupling end 205 of reservoir 200 on neck portion 212 (see FIG. 3) forming a leak resistant seal between bladder 204 and reservoir housing 201 to prevent or minimize leakage of oral care fluid 203 into cavity 202 of the housing. Bladder 204 may be sealed to neck portion 212 by any suitable conventional means used in the art such as heat or sonic welding, adhesives, etc. Bladder 204 may have any suitable shape and preferably may conform generally to the shape of reservoir housing 201.

With continuing reference to FIGS. 1-3 and 7, bladder 204 preferably is sized to be slightly smaller in length and/or diameter than reservoir housing cavity 202 by an amount sufficient to provide a small trapped space or gap therebetween to allow air to enter through an external venting hole 213. Accordingly, housing cavity 202 preferably has a volumetric capacity that is larger than the volumetric capacity of a fully filled bladder 204. This allows the pressure inside cavity 202 and surrounding bladder 204 to essentially equal atmospheric pressure external to housing 201 which enables the bladder to at least partially collapse when an amount of oral care fluid 203 is dispensed from the bladder, as further described herein elsewhere.

Bladder 204 may be made of any suitable deformable and collapsible material. The selected material, however, should be compatible with the oral care agent or fluid 203 that is to be stored within the bladder 204 and preferably should not be corroded, embrittled, crack, or otherwise degraded by the oral care agents or fluids during storage therein for a reasonable period of time.

Reservoir 200 may be packaged and provided separately from toothbrush handle 103 to the user or consumer. Accordingly, reservoir 200 may include a conventional threaded closure (not shown) that is removably attached to threaded neck portion 212 of the reservoir. Such an arrangement make it possible for the user to obtain replacement reservoirs 200 containing similar or may different oral care product formulations without having to dispose of the original. Accordingly, other aspects of the present invention includes oral care kits which may contain a single toothbrush 100 having a handle 103 and at least two or more interchangeable reservoirs 200 attachable to the handle and containing various different or the same formulations of oral care agents or fluids 203 contained therein.

Oral care fluid 203, which serves as a carrier mechanism for one or more active oral care agents, may be of any suitable viscosity substance ranging from preferably moderately viscous pastes/gels or less viscous liquid compositions so long as the fluid 203 may be actuated, flow through, and dispensed from toothbrush 100 by the dispensing system described herein. Any suitable active or inactive oral care agent can be used in embodiments of the present invention. For example, the oral care agent may include whitening agents, including without limitation, peroxide containing tooth whitening compositions. Suitable peroxide containing tooth whitening compositions are disclosed in U.S. patent Ser. No. 11/403,372, filed Apr. 13, 2006, to the present assignee, the entirety of which is hereby incorporated by reference. While a tooth whitening agent is one agent that may be used in the present invention, any other suitable other oral agents can be used and stored within reservoir 200. Contemplated possible oral care agents include without limitation, antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. The oral care agent, however, is preferably free of (i.e., is not) toothpaste. Instead, the oral care agent is intended to provide supplemental oral care benefits in addition to merely brushing one's teeth.

Figure 6:
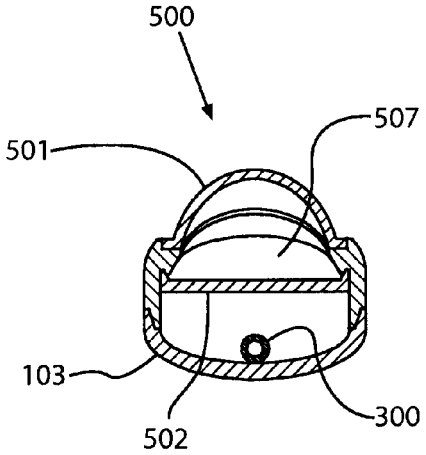
FIG. 6 is a lateral cross-sectional view taken through a middle section of the toothbrush handle of FIG. 1 showing a lateral cross section of a manual fluid pump disposed therein.

Referring to FIGS. 1-3, the fluid dispensing system further includes a manually actuated pump 500 for dispensing oral care fluid 203 from toothbrush 100. FIG. 7 depicts an enlarged longitudinal cross-sectional view through toothbrush handle 103 and FIG. 6 is an enlarged lateral cross-sectional view thereof. Pump 500 in one preferred exemplary embodiment may be an elastomeric diaphragm pump including a rigid fixed floor plate 502 mounted to distal portion 111 of handle 103 and an opposing flexible and resiliently deformable elastomeric actuating dome 501 spaced vertically apart from the floor plate. A deformable compression chamber 507 is defined between floor plate 502 and actuating dome 501 which defines a compressible volume of the compression chamber. In one exemplary embodiment, actuating dome 501 may have a partial ellipsoidal shape including a convex actuating surface 508 intended to be depressed by the thumb or finger of a user to actuate the pump. Convex surface 508 may be arcuately shaped in both the longitudinal and transverse or lateral directions with respect to longitudinal axis LA as shown in FIGS. 6 and 7. When depressed by a user applying an inward pressing force F preferably with the thumb, actuating dome 501 with convex surface 508 is movable toward and away from fixed floor plate 502 between an unactuated and undepressed position shown in FIGS. 6 and 7 to a partially or fully actuated depressed position (not shown) being moved towards floor plate 502 (see directional displacement arrows, FIG. 7).

Floor plate 502 may be made of any suitable rigid material including preferably rigid thermoplastics such as the exemplary plastic materials already described herein for portions of toothbrush 100 and handle 103. Actuating dome 501 may be made of any suitable elastomeric resiliently deformable material having a memory that allows the dome to be depressed by the user and then relatively quickly return to its original undeformed shape.

Referring to FIGS. 1-3, 6, and 7, pump 500 further includes an inlet fitting 503 and an outlet tube fitting 504 as best shown in FIG. 7. Inlet and outlet fittings 503, 504 are preferably made of a rigid plastic material. Outlet tube fitting 504 may be separate component secured in an aperture 509 defined in floor plate 502 by any suitable conventional means used in the art such as snap fit, ultrasonic welding, adhesives, etc. In other possible embodiments, outlet tube fitting 504 may be integrally molded with floor plate 502.

Inlet fitting 503 fluidly communicates with reservoir 200 as best shown in FIG. 7 and provides a flow path for oral care fluid 203 from reservoir 200 into compression chamber 507 (see directional flow arrows). Outlet fitting 504 fluidly communicates with flow conduit 300 providing a flow path between pump 500 and toothbrush head 103 (see direction flow arrows). In one possible embodiment, outlet fitting 504 may be configured as a tubing elbow as shown to for coupling to flow conduit 300; however, any other suitable configuration is possible depending on the shape and/or routing of flow conduit 300.

Figure 5:
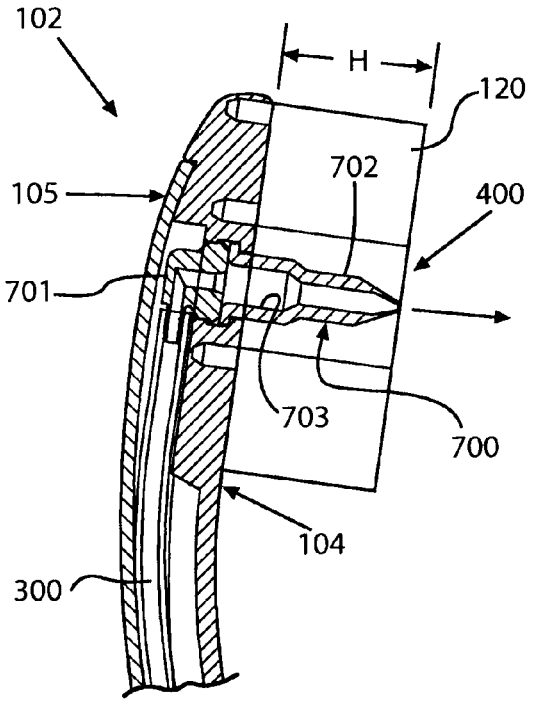
FIG. 5 is a cross-sectional side view thereof.

In some preferred exemplary embodiments, flow conduit 300 may be made of a conventional food grade flexible plastic tubing as shown in FIGS. 2, 5, and 7. Flow conduit 300 may be routed through toothbrush handle 103, neck 101, and head 102 in any suitable manner. The inlet or outlet fittings used on either end of flow conduit 300 may therefore preferably be standard commercially available tubing fittings adapted for coupling to flexible tubing. In other embodiments contemplated, flow conduit 300 may be made of rigid plastic tubing or formed as an open flow path integrally molded with the handle 103, neck 101, and head 102 of toothbrush 100. The invention is not limited to any particular type of flow conduit used.

The operation of actuated pump 500 will be described more fully herein elsewhere.

Referring to FIG. 2, the fluid dispensing system further includes a first check valve 600 and a second check valve 700. With additional reference to FIGS. 7-10, first check valve 600 is preferably disposed upstream in the flow path between reservoir 200 and pump 500. Valve 600 may be permanently attached to or non-permanently positioned in inlet fitting 503 or distal portion 111 of toothbrush handle 103 in a suitably configured seating surface 505 (see FIG. 7) configured to secure the valve thereon. In one possible embodiment, valve 600 is trapped between end sealing surface 206 of reservoir 200 (see FIG. 3) and seating surface 505 on handle 103 as best shown in FIG. 7 to form a tight leak-resistant seal between the reservoir and toothbrush handle 103.

Figure 8:
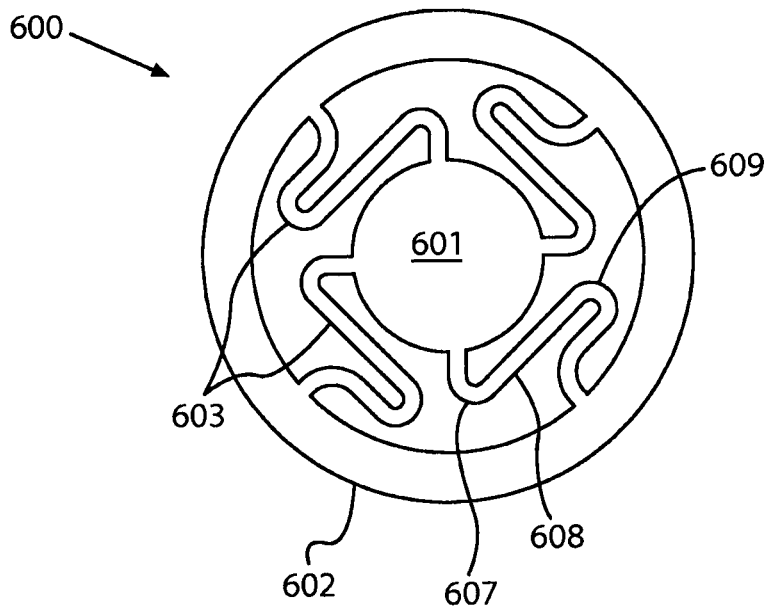
FIG. 8 is a top plan view of one embodiment of a check valve of the fluid dispensing system of the toothbrush of FIG. 1.
Figure 9:
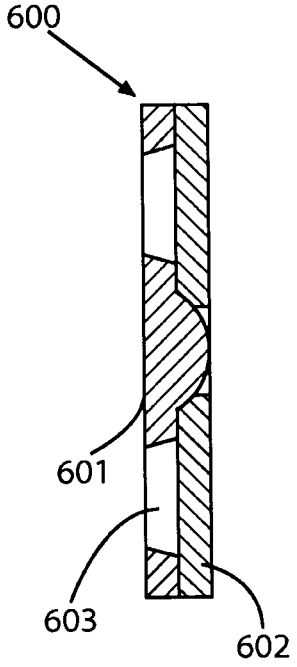
FIG. 9 is a cross-sectional side view thereof showing the valve in a closed position.
Figure 10:
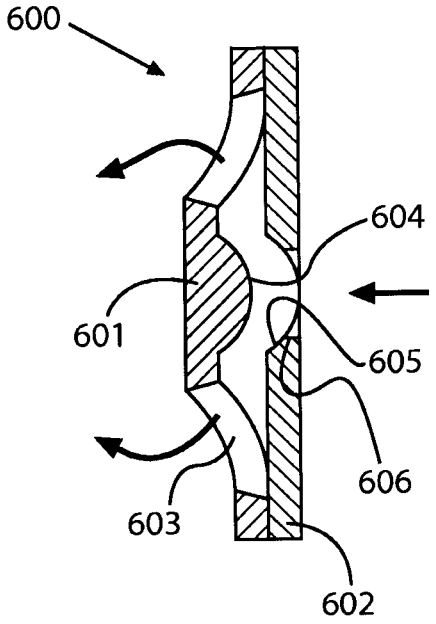
FIG. 10 is a cross-sectional side view thereof showing the valve in an open position.
Figure 11:
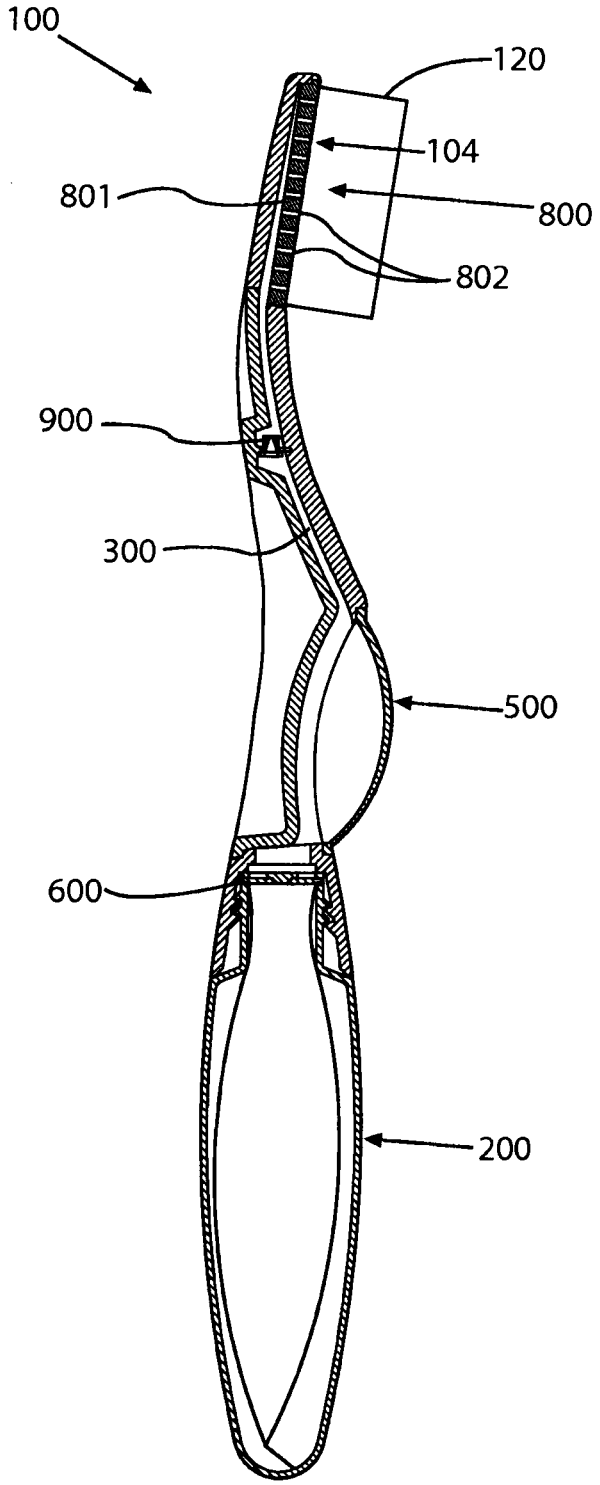
FIG. 11 is a longitudinal cross-sectional side view of the toothbrush of FIG. 1 having a second embodiment of a fluid dispensing system according to the present invention.
Figure 12:
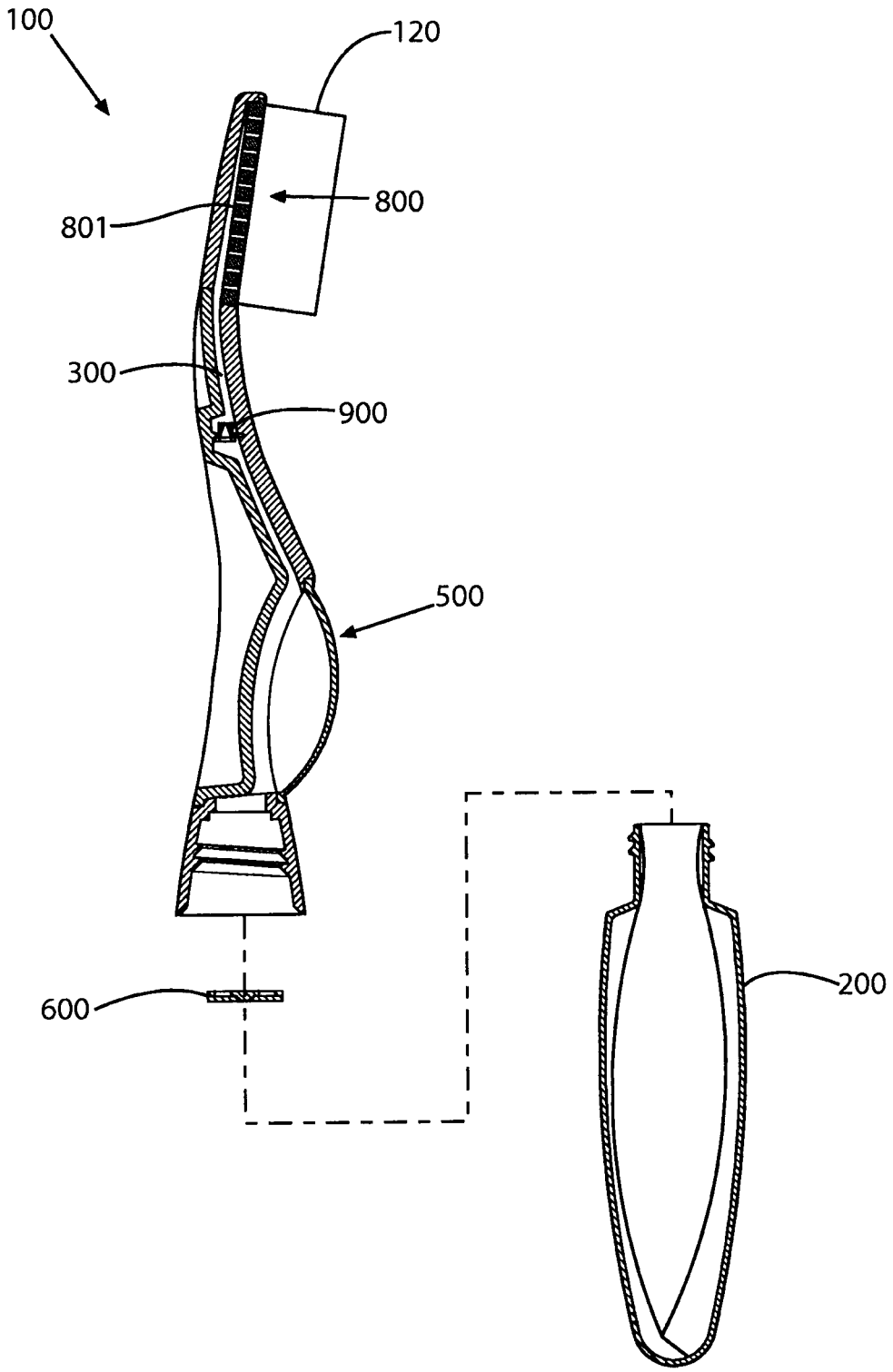
FIG. 12 is an exploded cross-sectional view thereof.

Referring to FIGS. 8-10, first check valve 600 preferably is an elastomeric valve and may be generally disc or circular shaped as best shown in FIG. 8. Valve 600 includes an axially movable plug 601, annular valve seat 602 concentrically aligned and radially spaced from seat 602, and a plurality of radially extending supporting members 603 resiliently attaching the plug to the seat. Supporting members 603 preferably establish open spaces or gaps between valve plug 601 and valve seat 602 to establish a flow path therebetween for fluid 203 flow through the valve when in an open position. In one possible embodiment, supporting members 603 may be generally configured as S-shaped ligaments circumferentially spaced around disc-shaped valve plug 602. The S-shape provides a good degree of flexibility and movable support for the plug 601 allowing the plug 601 to open for passing fluid. In one possible preferred embodiment, four supporting members 603 may be provided with one member being attached to each quadrant of valve plug 601. In other embodiments, more or less supporting members 603 may be provided. S-shaped supporting members 603 may include a first curved section 607 connected to plug 601, a second curved section 609 connected to seat 602, and a straight section 608 disposed therebetween as best shown in FIG. 8. Accordingly, in the embodiment shown, supporting members 603 have sections that are oriented both radially and tangentially to valve plug 610 to provide flexibility in at least two or more lateral directions and perpendicular to valve seat 602 for passing flow between the plug and seat.

With continuing reference to FIGS. 8-10, valve plug 601 is movable from a closed position shown in FIG. 9 to an open position shown in FIG. 10 in which flow through the valve is enabled. Valve plug 601 may include an arcuately shaped convex sealing surface 604 which engages a complementary configured arcuately shaped concave annular sealing surface 605 disposed in valve seat 602 defining a flow aperture 606 therethrough. When check valve 600 is in the closed position shown in FIG. 9, convex sealing surface 604 of valve plug 601 is preferably tightly seated against concave sealing surface 605 of valve seat 602 to prevent flow backwards through the valve into reservoir 200. When check valve 600 is in an open position as shown in FIG. 10, flow of oral care fluid 203 is permitted in one direction through the valve from reservoir 200 to inlet fitting 503 and compression chamber 507 as indicated by the flow arrows with valve plug 601 being axially displaced in a direction perpendicular from valve seat 602 thereby creating a flow path.

Although FIGS. 8-10 depict a preferred exemplary embodiment of a first check valve 600, other suitable commercially available elastomeric valve types or mechanically spring-actuated type check valves may be substituted.

Figure 4:
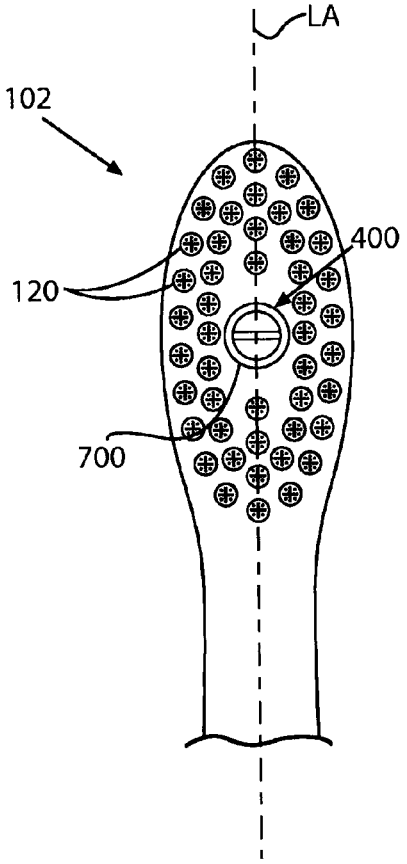
FIG. 4 is an enlarged top plan view of the front brushing side of the toothbrush head of FIG. 1.

Referring to FIGS. 2, 4, and 5, second check valve 700 in the embodiment shown may be disposed on toothbrush head 102 and nested in tooth cleaning elements 120. Check valve 700 is preferably an elastomeric valve, more preferably in one exemplary embodiment is a "duck bill" type check valve which defines the fluid outlet 400 of the fluid dispensing system in toothbrush head 102. Valve 700 preferably has a height that generally coincides with the height H of tooth cleaning elements 120 (see FIG. 5). Second check valve 700 has an elongated shape and is disposed generally perpendicular to front brushing surface 104 of toothbrush head 102 to dispense oral care fluid 203 in a transverse direction to longitudinal axis LA. Check valve 700 includes an internal flow cavity 703 and two opposing flexible elastomeric movable flaps 702 which open outwards from each other and the axis of the valve in response to fluid flow and pressure (i.e. open position—not shown), and then resiliently closes back together again once fluid flow and pressure ceases (i.e. closed position—shown in FIGS. 4 and 5). Second check valve 700 further includes an associated inlet tube fitting 701 which preferably is made of a rigid plastic material and is configured for coupling to flow tube conduit 300 for supplying oral care fluid 203 to the valve. In one embodiment, inlet fitting 701 may be a shaped as an elbow, however, other possible configurations are contemplated depending on the orientation of valve 700 and routing of flow conduit 300.

Operation of toothbrush 100 and the fluid dispensing system will now be described with initial reference to FIGS. 2, 5, 7 and 8-10. If the reservoir 200 is provided to the user separately from the toothbrush handle 103 or the user has purchased a refill, the user would rotatably thread and attach the reservoir to the handle. Toothbrush 100 is now ready for use. The dispensing operation then begins with a priming step. While the user is brushing his/her teeth, the user presses downward and inward with a pressing force F on the deformable actuating dome 501 and convex actuating surface 508 of pump 500 thereby compressing the volume of the compression chamber 507 with his/her thumb to first prime the fluid dispensing system with oral care fluid 203 from reservoir 200. Actuating dome 501 and surface 508 move towards floor plate 502 (see displacement arrows FIG. 7) and fully or partially collapses the dome thereby squeezing or compressing the volume and forcing any air in pump 500 forward and outwards from second check valve 700 in toothbrush head 102. The first check valve 600 remains in the closed position (FIG. 9) and prevent air flow back through the valve into reservoir 200 and bladder 204.

Next, as the user then releases thumb pressure from the actuating dome 501 which is returned to its unactuated and undeformed position shown in FIG. 7, a vacuum is formed in the compression chamber 507. The vacuum causes valve plug 601 of first check valve 600 to unseat and move away from check valve seat 602 moving the valve to the open position (FIG. 10) and allowing oral care fluid 203 at higher pressure in deformable bladder 204 to flow forward from the bladder into the evacuated compression chamber 507 of pump 500 through inlet 505. Venting hole 213 of toothbrush handle 103 allows the interior cavity 202 of the handle to be in communication with external atmospheric pressure. This then allows the deformable bladder 204 to partially collapse in volume by an amount approximately equal to the oral care fluid 203 volume dispensed through check valve 600 into the compression chamber 507. The bladder 204 will thereafter continue to partially collapse each time oral care fluid 203 is subsequently dispensed from the bladder until its contents are eventually depleted. This priming step is now completed and oral care fluid 203 is now disposed in pump 500 and compression chamber 507 ready for the fluid dispensing step.

In the dispensing step which then follows, the consumer next presses downwards and inwards again for a second time on the deformable actuating dome 501 and convex actuating surface 508 of pump 500 which is filled with oral care fluid 203 (see FIG. 7). This action increases fluid pressure in the compression chamber 507 by the reduction in the volume of the fully or partially collapsed chamber. The increased pressure in the chamber 507 forces valve plug 601 of the first check valve 600 against check valve seat 602 maintaining the valve in the closed position (FIG. 9) thereby preventing fluid 203 from returning to the deformable bladder 204. The now pressurized fluid 203 then flows through the outlet tube fitting 504 of pump 500 into and forward through the flow conduit 300 to inlet tube fitting 701 in toothbrush head 102 where the fluid pressurizes cavity 703 of the second check valve 700. This pressure causes the normally closed second check valve 700 (see FIG. 5) to deform and opens flaps 702 thereby dispensing oral care fluid 203 from the valve to the oral cavity of the user. The amount of oral care fluid 203 dispensed will be approximately equal to that contained in compression chamber 507 of pump 500.

Next, the user releases actuating dome 501 and convex actuating surface 508 of pump 500. The previously deformed and collapsed actuating dome 501 returns to its original undeformed position shown in FIG. 7. Once the pressure in the fluid dispensing system is relieved as a result of the volume of liquid in compression chamber 507 of pump 500 being dispensed through the second check valve 700, and the user releases their thumb and pressing force F from convex actuating surface 508, a vacuum is next formed in the compression chamber which closes the second check valve 700 and essentially simultaneously causes first check valve 600 to again unseat and open (see FIG. 10) allowing oral care fluid 203 to once again flow forward into and refill the compression chamber 507. Pump 500 is returned again therefore to the unactuated and undepressed position shown in FIGS. 6 and 7 ready for the next dispensing cycle.

The foregoing dispensing cycle may be repeated as desired by the user as the actuating surface 508 of actuating dome 501 is depressed and released in an alternating manner as described above. This repeatedly moves the dome 501 between the unactuated/undepressed position shown in FIGS. 6 and 7 to the actuated position in which deformable compression chamber 507 is partially or fully collapsed (not shown) depending on the distance and amount that the user depresses the actuating dome of pump 500.

FIGS. 11-16 show an embodiment and construction of a toothbrush 100 with the fluid dispensing system having a second alternative arrangement for dispensing oral care fluid 203. The toothbrush 100 is similar in construction to the embodiments shown in FIGS. 1-10 and described herein in all respects, except primarily that a fluid outlet 800 comprises a plurality of dispensing ports 802 in lieu of a single fluid dispensing outlet 400 in the form of second check valve 700 as in the prior embodiment. Some minor modifications to the fluid dispensing system to accommodate this change are described below.

Referring to FIGS. 11-14, the fluid dispensing system includes first check valve 600 and a differently configured second elastomeric check valve 900 disposed in flow conduit 300 between pump 500 and toothbrush head 102. In one embodiment, valve 900 preferably is disposed in neck 101 or distal portion 111 of toothbrush handle 103. Valve 900 provides essentially the same functionality and operates similarly to valve 700 described before. Accordingly, the method of operating toothbrush 100 and the fluid dispensing system as described above in detail is essentially the same in principle.

Figure 14:
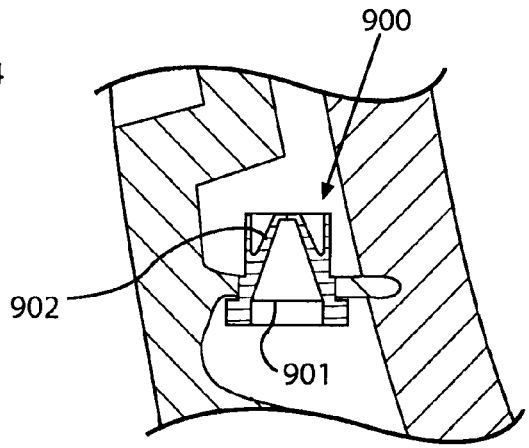
FIG. 14 is a longitudinal cross-sectional side view taken through a portion of the neck of the toothbrush and fluid dispensing system of FIG. 11 showing another embodiment of a check valve.

Referring to FIG. 14, second check valve 900 in one embodiment may have a conical flow cavity 901 and two opposing flexible elastomeric movable flaps 902 which open in response to fluid flow and pressure (i.e. open position—not shown), and then resiliently closes again once fluid flow and pressure ceases (i.e. closed position shown in FIG. 14) similarly to second check valve 700 described herein.

Figure 17:
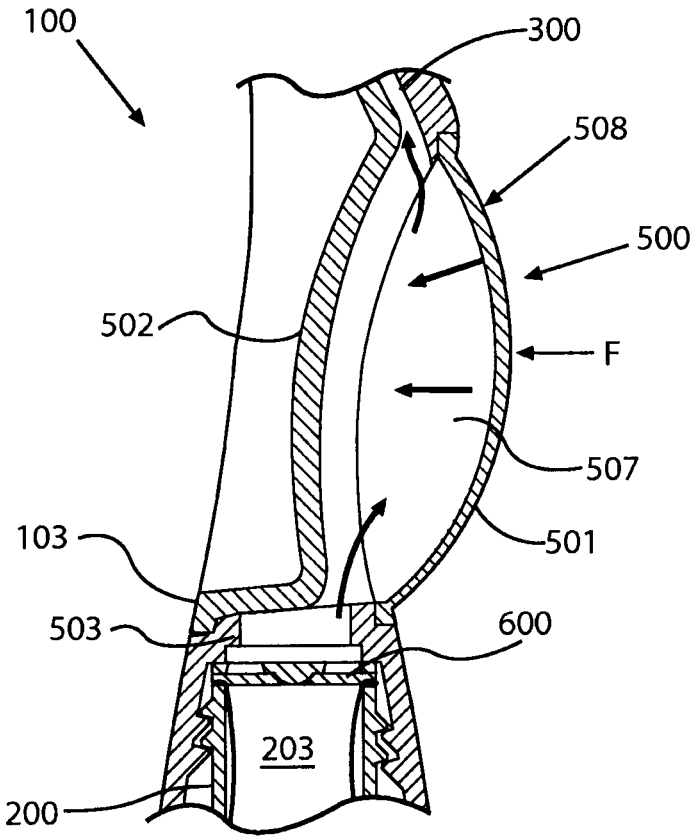
FIG. 17 is a partial longitudinal cross-sectional side view taken through a middle section of the toothbrush handle of FIG. 11 showing second embodiment of a manual fluid pump disposed therein.

Referring to FIGS. 11-14 and 17, an alternative embodiment or construction of flow conduit 300 is shown which is integrally molded as part of toothbrush handle 103 and neck 101, in lieu of being in the form of a separate plastic flow tube connected between tube fittings as described herein with respect to the embodiment shown in FIG. 1. Accordingly, diaphragm pump 500 does not include an outlet tube fitting 504 per se and the outlet is formed as a smooth transition between deformable compression chamber 507 and flow conduit 300 as best shown in FIG. 17. Pump 500 operates the same as already described herein in all pertinent respects.

Figure 13:
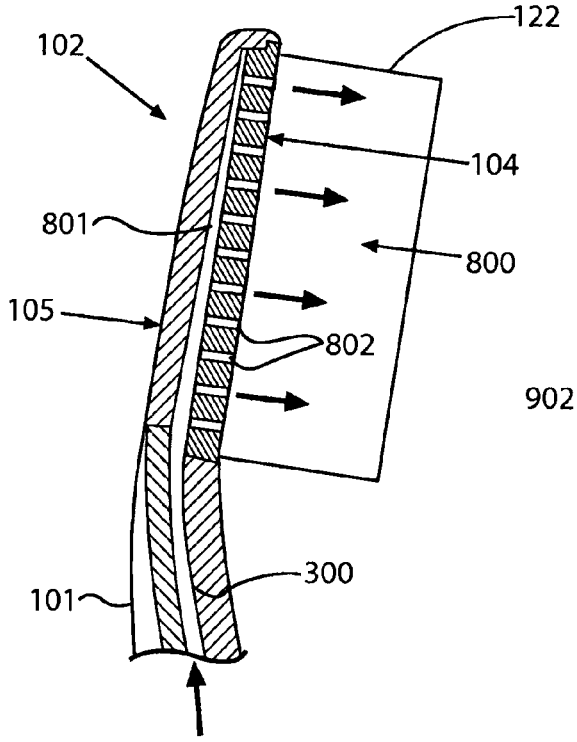
FIG. 13 is an enlarged cross-sectional side view taken through the toothbrush head and fluid dispensing system of the toothbrush of FIG. 11.

Referring to FIGS. 11, 13, and 15-16, toothbrush 100 in this embodiment includes a flow plenum 801 disposed between front surface 104 and back surface 105 of toothbrush head 102 which is fluidly coupled to flow conduit 300 routed through neck 101 of the toothbrush. Toothbrush head 102 includes a plurality of fluid dispensing ports 802 which are fluidly coupled to flow plenum 801 and extend transversely outwards through front surface 104 as best shown in FIG. 13. Oral care fluid 203 pumped by pump 500 in the manner already described herein flows through flow conduit 300, plenum 801, and is distributed and dispensed to the user preferably during brushing through the multiple dispensing ports 802 incorporated into toothbrush head 102 (see flow arrows, FIG. 13).

Figure 15:
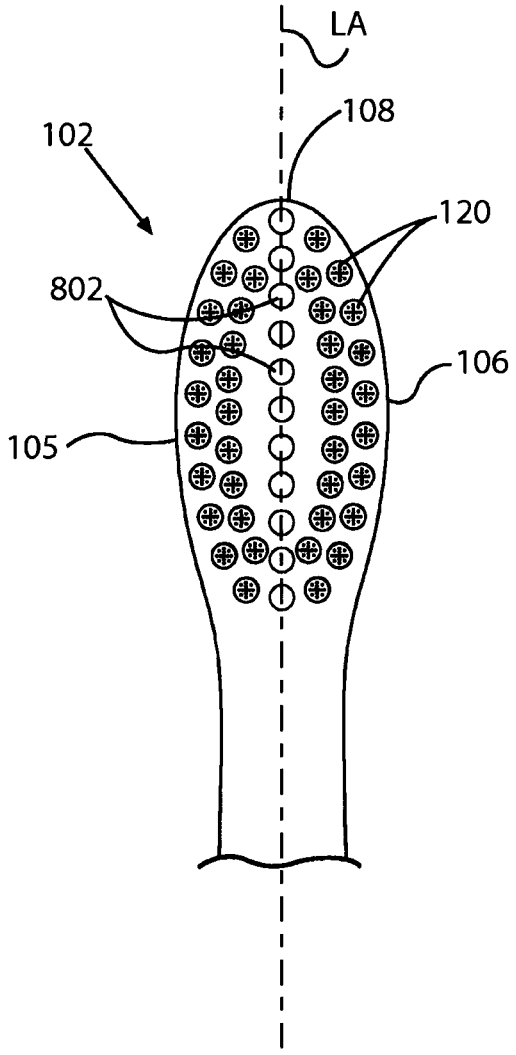
FIG. 15 is an enlarged top plan view of one embodiment of front brushing side of the toothbrush head of FIG. 11 showing a first possible fluid dispensing outlet port pattern.
Figure 16:
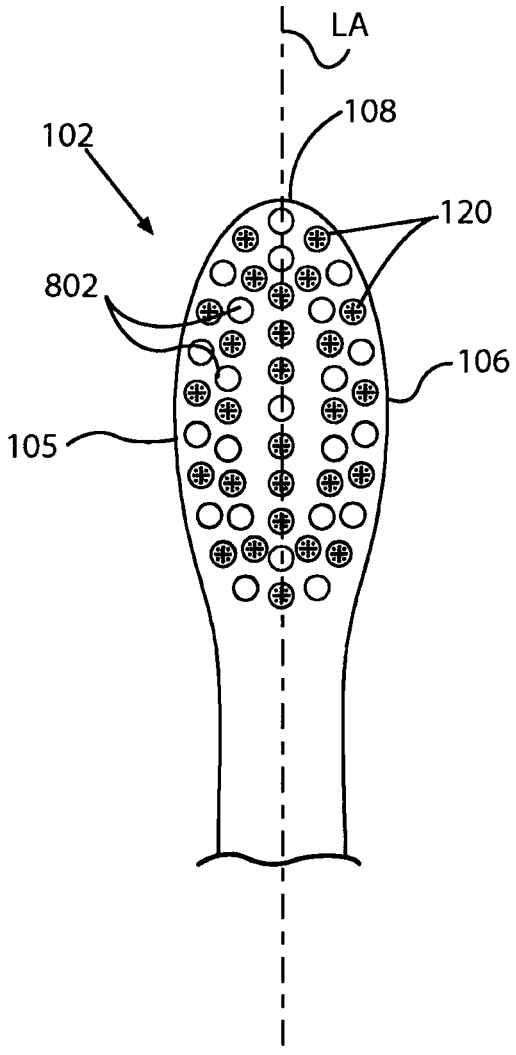
FIG. 16 is an enlarged top plan view of another embodiment of front brushing side of the toothbrush head of FIG. 11 showing a second possible fluid dispensing outlet port pattern.

Referring to FIGS. 13 and 15-16, fluid dispensing ports 802 are preferably interspersed between or among tooth cleaning elements 120. The dispensing ports 802 may be arranged in any number of possible patterns in toothbrush head 102. FIG. 15 shows one possible arrangement in which dispensing ports 802 are axially aligned with the longitudinal axis LA of the toothbrush head 102. FIG. 16 shows an alternate arrangement in which dispensing ports 802 are scattered across toothbrush head 102 having some ports disposed along longitudinal axis LA and others positioned laterally between longitudinal axis LA and lateral sides 105, 106 of the head as shown. Other suitable arrangements of fluid dispensing ports 802 may be used depending on the specific design intent for dispensing the oral care fluid 203 among the tooth cleaning elements 120.

Depending on the pattern and arrangement of fluid dispensing ports 802 used, flow plenum 801 which supplies oral care fluid 203 to the dispensing ports may have any suitable longitudinal and lateral extent so long as all of the ports may be supplied with fluid. In some embodiments, therefore, plenum 801 may extend longitudinally all the way to distal end 108 of toothbrush 100 on toothbrush head 102 such as in the arrangements shown in FIGS. 15 and 16 wherein the distal most dispensing port 802 is adjacent end 108. In some embodiments, flow plenum 801 may have a lateral extent (i.e. between lateral sides 105, 106 perpendicular to longitudinal axis LA) that is relatively narrow such as in the arrangement of dispensing ports 802 shown in FIG. 15 wherein there are no dispensing ports 802 other than along longitudinal axis LA. In other embodiments, as shown in FIG. 16, flow plenum 801 extends from lateral side 105 to opposite lateral side 106 and from the proximal portion of toothbrush head 102 to distal end 108 to supply oral care fluid 203 to all ports. Accordingly, flow plenum 801 may have any suitable configuration and dimensional extent, and the invention is not limited to any particular arrangement.

The devices and apparatuses described herein utilize conventional, commercially-available components which will be readily known to and obtainable by those skilled in the art. Therefore, it is well within ambit of those skilled in the art to assemble such components to create these devices and to employ the methods described herein without undue experimentation.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A toothbrush comprising:

a handle;

a neck supported by the handle;

a head supported by the neck and including a plurality of tooth cleaning elements; and a reservoir having a housing coupled to the handle and including a collapsible bladder holding an oral care fluid, wherein the reservoir housing defines an internal cavity that houses the bladder, wherein an open distal end of the bladder is fixed to the housing, and the bladder being in fluid communication with a fluid dispensing outlet disposed in the head; and a manually actuated pump disposed in the handle;

wherein actuating the pump causes the fluid to flow from the bladder to the outlet wherein the fluid is dispensed.

2. The toothbrush of claim 1, wherein the bladder collapses by an amount essentially equal to the amount of fluid dispensed.

3. The toothbrush of claim 1, wherein the reservoir housing includes an externally open venting hole that pressurizes the cavity at essentially atmospheric pressure for enabling the bladder to collapse when dispensing fluid.

4. The toothbrush of claim 1, wherein the reservoir housing includes a neck portion and the bladder includes an open distal end that is annularly sealed to a distal interior surface of the housing neck portion for preventing leakage into the cavity from the distal end of the bladder.

5. The toothbrush of claim 1, further comprising an elastomeric first check valve disposed adjacent to an open distal end of the bladder and an inlet to the pump.

6. The toothbrush of claim 5, wherein the reservoir housing includes a neck portion having an end sealing surface that compresses a valve seat of the first check valve when the neck portion is coupled to the handle.

7. The toothbrush of claim 5, wherein the first check valve is disc-shaped and includes a displaceable valve plug, an annular seat complementary configured to engage the plug, and a plurality of supporting members resiliently connecting the plug to the seat.

8. The toothbrush of claim 1, wherein the reservoir housing includes a threaded neck portion that is rotatably received in a threaded socket on the proximal portion of the handle.

9. The toothbrush of claim 1, wherein the fluid dispensing outlet includes an elastomeric duck bill check valve.

10. The toothbrush of claim 1, wherein the fluid dispensing outlet includes a plurality of dispensing ports disposed in a front brushing surface of the toothbrush head.

11. A toothbrush comprising;

a handle having a proximal portion and a distal portion;

a neck supported by the handle;

a head supported by the neck and including a plurality of tooth cleaning elements;

a removable reservoir thresdably coupled to the handle for holding an oral care fluid and including a cavity having a collapsible bladder disposed therein containing an oral care fluid, wherein an open distal end of the bladder is fixed to the housing, and the bladder being in fluid communication with a fluid dispensing outlet disposed in the head;

a manually actuated pump disposed in the handle and having an inlet and an outlet, the pump including a depressible elastomeric convex surface;

a fluid dispensing system comprising a first check valve disposed upstream of the pump and a second check valve disposed downstream of the pump, the system further including a flow conduit fluidly connecting the pump to the fluid dispensing outlet;

wherein when a user depresses the convex surface of the pump, the fluid flows from the bladder to the fluid dispensing outlet and the bladder partially collapses.

12. The toothbrush of claim 11, wherein the reservoir housing includes an externally open vent hole that pressurizes the cavity at essentially atmospheric pressure for enabling the bladder to collapse when dispensing fluid.

13. The toothbrush of claim 11, wherein the first check valve is disc-shaped and includes a displaceable valve plug, an annular seat configured to engage the plug, and a plurality of supporting members resiliently connecting the plug to the seat.

14. The toothbrush of claim 11, wherein the reservoir housing includes a threaded neck portion that is rotatably received in a threaded socket on the proximal portion of the handle.

15. The toothbrush of claim 11, wherein the dispensing outlet includes the second check valve which is an elastomeric duck bill check valve.

16. The toothbrush of claim 11, wherein the second check valve is disposed in the flow conduit of the toothbrush upstream of the toothbrush head.

17. The toothbrush of claim 11, wherein the reservoir includes a neck portion having an end sealing surface that compresses a valve seat of the first check valve when the neck portion is threadably coupled to the handle.

18. The toothbrush of claim 11, wherein the proximal portion of the handle is tapered for user comfort while brushing.

19. The toothbrush of claim 11, wherein the fluid dispensing outlet includes a plurality of dispensing ports disposed in the head of the toothbrush.

20. A method of dispensing an oral care fluid from a toothbrush comprising:

providing a toothbrush including a handle, a neck supported by the handle, and a head supported by the neck portion, the toothbrush further including a fluid dispensing system;

rotatably coupling to the handle a removable reservoir having a housing defining a cavity including a collapsible bladder therein holding an oral care fluid, wherein an open distal end of the bladder is fixed to the housing, and;

depressing an elastomeric convex surface of a manual pump fluidly connected to the fluid dispensing system; and dispensing the oral care fluid from an outlet in the head of the toothbrush.

21. The method of claim 20, wherein the bladder partially collapses during the dispensing step.

22. The method of claim 20, wherein the fluid flows through two check valves disposed in the fluid dispensing system during the dispensing step.

23. The method of claim 20, further comprising pressuring the cavity of reservoir to atmospheric pressure.

24. An oral care kit, comprising:

a toothbrush comprising a handle, a neck supported by the handle, a head supported by the neck and including a plurality of tooth cleaning elements and a fluid dispensing outlet, and a manually actuated pump disposed in the handle; and a reservoir having a housing removably couplabte to the handle and including a collapsible bladder holding an oral care fluid, wherein the reservoir housing defines an internal cavity that houses the bladder, wherein an open distal end of the bladder is fixed to the housing;

wherein, when the housing of the reservoir is coupled to the handle, activation of the pump causes the fluid to flow from the bladder to the outlet wherein the fluid is dispensed.

25. The oral care kit of claim 24, further comprising a threaded closure removably attached to a threaded neck portion of the reservoir.

26. The oral care kit of claim 24, wherein the housing is threadably couplable to the handle.

* * * * *